US006224009B1

(12) United States Patent
Zenoni

(10) Patent No.: US 6,224,009 B1
(45) Date of Patent: May 1, 2001

(54) DEVICE FOR MODULATED BRAKING OF A WEFT YARN FOR TEXTILE MACHINES

(75) Inventor: Pietro Zenoni, Leffe (IT)

(73) Assignee: L.G.L. Electronics S.p.A., Gandino (IT)

( * ) Notice: Subject to any disclaimer, the term of this patent is extended or adjusted under 35 U.S.C. 154(b) by 0 days.

(21) Appl. No.: 09/347,303

(22) Filed: Jul. 6, 1999

(30) Foreign Application Priority Data

Jul. 17, 1998 (IT) ..... T098A0621

(51) Int. Cl.[7] ..... B65H 59/26

(52) U.S. Cl. ..... 242/419.7; 242/419.3; 242/147 M

(58) Field of Search ..... 242/419.3, 419.7, 242/147 M, 154; 310/23

(56) References Cited

U.S. PATENT DOCUMENTS

| | | | | |
|---|---|---|---|---|
| 357,374 | * | 2/1887 | Darling et al. | 310/23 |
| 1,619,677 | * | 3/1927 | Pierce | 310/23 X |
| 2,635,854 | * | 4/1953 | Richards et al. | 310/23 X |
| 2,861,778 | * | 11/1958 | Spurlin | 310/23 X |
| 3,300,161 | | 1/1967 | Hermanns . | |
| 3,448,307 | * | 6/1969 | Duris | 310/23 |
| 3,549,917 | * | 12/1970 | Espenschied et al. | 310/23 X |
| 3,709,332 | * | 1/1973 | Rosen | 242/147 M X |
| 4,909,379 | * | 3/1990 | Albeck et al. | 310/23 X |
| 4,927,093 | * | 5/1990 | Weidmann | 242/154 |
| 4,928,028 | * | 5/1990 | Leibovich | 310/23 |
| 5,077,515 | * | 12/1991 | St. Arnauld | 310/23 X |
| 5,155,399 | * | 10/1992 | Zimmermann | 310/23 |
| 5,309,050 | * | 5/1994 | Morinigo et al. | 310/23 X |
| 5,520,351 | * | 5/1996 | Prospero et al. | 242/419.7 |
| 5,738,295 | * | 4/1998 | Flamm et al. | 242/419.7 X |
| 5,833,440 | * | 11/1998 | Berling | 310/23 X |
| 5,857,637 | * | 1/1999 | Straaten et al. | 242/419.3 X |
| 5,871,163 | * | 2/1999 | Bertoli et al. | 242/419.3 X |
| 6,066,998 | * | 5/2000 | Trumper et al. | 335/229 |

FOREIGN PATENT DOCUMENTS

| | | | |
|---|---|---|---|
| 4335089 | | 4/1994 | (DE) . |
| 0467059 | | 1/1992 | (EP) . |
| 0527510 | | 2/1993 | (EP) . |
| 0826806 | | 3/1998 | (EP) . |
| 942083 | * | 9/1999 | (EP) . |
| 97 49630 | | 12/1997 | (WO) . |

* cited by examiner

*Primary Examiner*—Donald P. Walsh
*Assistant Examiner*—Collin A. Webb
(74) *Attorney, Agent, or Firm*—Guido Modiano; Albert Josif; Daniel O'Byrne

(57) ABSTRACT

Device for modulated braking of a weft yarn for textile machines, comprising a set of three yarn guiding eyes, which form a straight path for the yarn, and an oscillating lever, which is connected to a U-shaped braking, element which straddles a central eye of said eyes and engages the yarn in free portions that lie between said central eye and the end eyes of said eyes in order to divert its straight path for braking, wherein the oscillating lever is controlled by an electromagnetic actuation means which comprises at least one permanent magnet which is constituted by a cylindrical body having a N-S polar axis arranged radially; the body is associated with a stem which is articulated to the oscillating lever and can move in a linear fashion inside a cylindrical shroud with high magnetic permeance, on which at least one coil is wound, an excitation current flowing through the coil; is the axis of the cylindrical shroud, which coincides with the axis of the movable stem, being perpendicular to the polar axis of the cylindrical permanent-magnet body.

7 Claims, 3 Drawing Sheets

DEVICE FOR MODULATED BRAKING OF A WEFT YARN FOR TEXTILE MACHINES

BACKGROUND OF THE INVENTION

The present invention relates to a device for modulated braking of a weft yarn for textile machines.

More specifically, the invention relates to a device of the type disclosed in the prior EPA No. 99103942.1 by same Applicant, which comprises a set of three fixed yarn guiding eyes, which determine a straight path of the weft yarn through the device, and at least one controlled braking element, which is adapted to engage the yarn in the spaces between said yarn guiding eyes in order to divert its straight path for braking.

In such conventional device, a movable electromagnetic yoke, subjected to the interacting actions of a constant magnetic field and of a current which circulates in an excitation coil, actuates a first oscillating lever with which the braking element proper is rigidly coupled. Said braking element is constituted by a second U-shaped oscillating lever which arranges itself so as to straddle the central yarn guiding eye and engages the yarn in the free portions that lie between the central eye and the end eyes.

The movable yoke is formed by a hollow cylindrical support on which the excitation coil is wound; the coil is immersed in the field of a permanent magnet which generates a flux which circulates in a cylindrical shroud of a material having high magnetic permeance.

Although this conventional device has a response which is generally adequate in terms of reaction to the extremely rapid variations in the mechanical tension of the yarn that occur in modern weaving processes, it is not entirely satisfactory from the constructive point of view, because of a certain mechanical fragility of the movable yoke, whose mass is intentionally very modest, and from the functional point of view, due to some uncertainty in the operation of the movable yoke, which sometimes, especially in the processing of higher-count yarns, can be subject to an electromotive force which is insufficient to produce an adequate response to the device in the above specified terms.

SUMMARY OF THE INVENTION

The aim of the present invention is to provide a modulated braking device improved so as to eliminate the above mentioned drawbacks.

Within the scope of this aim, a particular object of the present invention is to provide a device for modulated braking of a weft yarn for textile machines, comprising a set of three yarn guiding eyes, which form a straight path for the yarn, and an oscillating lever, which is connected to a U-shaped braking element which straddles a central eye of said eyes and engages the yarn in free portions that lie between said central eye and the end eyes of said eyes in order to divert its straight path for braking, characterized in that said oscillating lever is controlled by an electromagnetic actuation means which comprises at least one permanent magnet which is constituted by a cylindrical body having a N-S polar axis arranged radially, said body being associated with a stem which is articulated to said oscillating lever and can move in a linear fashion inside a cylindrical shroud with high magnetic permeance, on which at least one coil is wound, an excitation current flowing through said coil; the axis of said cylindrical shroud, which coincides with the axis of the movable stem, being perpendicular to the polar axis of said cylindrical permanent-magnet body.

Advantageously, according to the present invention, said cylindrical permanent-magnet body is made of one of the magnetic materials neodymium, samarium-cobalt and alloys thereof, and is connected on a support of nonmagnetic material, typically polymeric material, which is stably rigidly coupled to said movable stem.

According to a different embodiment of the present invention, a linear motion sensor is associated with the movable stem of the electromagnetic actuation means and is capable of providing a feedback signal which allows to control the current supplied to the excitation coil and accordingly control the speed and/or method of motion of said stem.

BRIEF DESCRIPTION OF THE DRAWINGS

Further characteristics and advantages of the present invention will become apparent from the following detailed description of preferred embodiments thereof, illustrated only by way of non-limitative example in the accompanying drawings, wherein.

DESCRIPTION OF THE PREFERRED EMBODIMENTS

Figure 2:
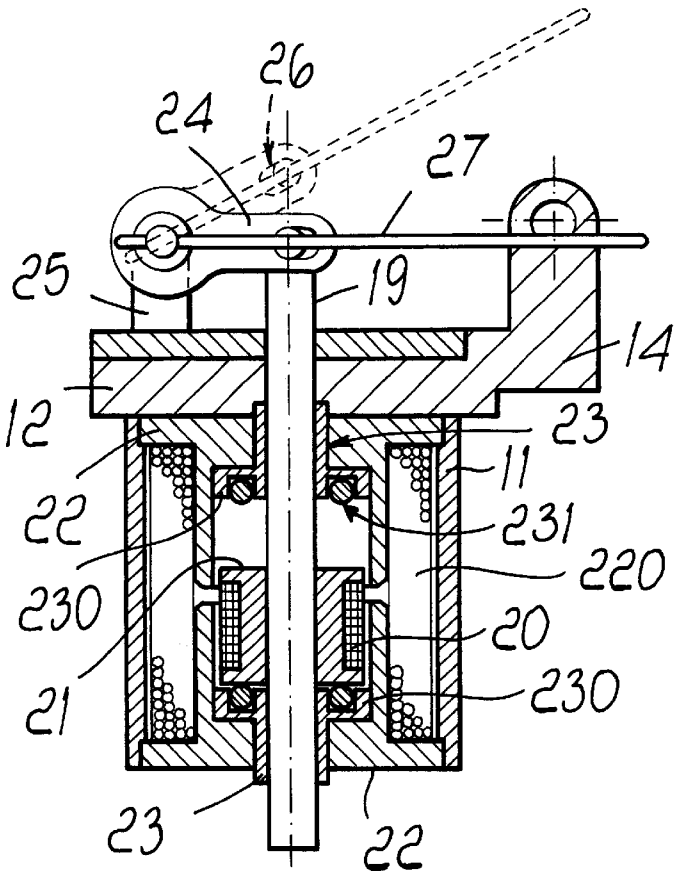
FIG. 2 is a transverse sectional view of the device, taken along the plane II—II of FIG. 1.
Figure 1:
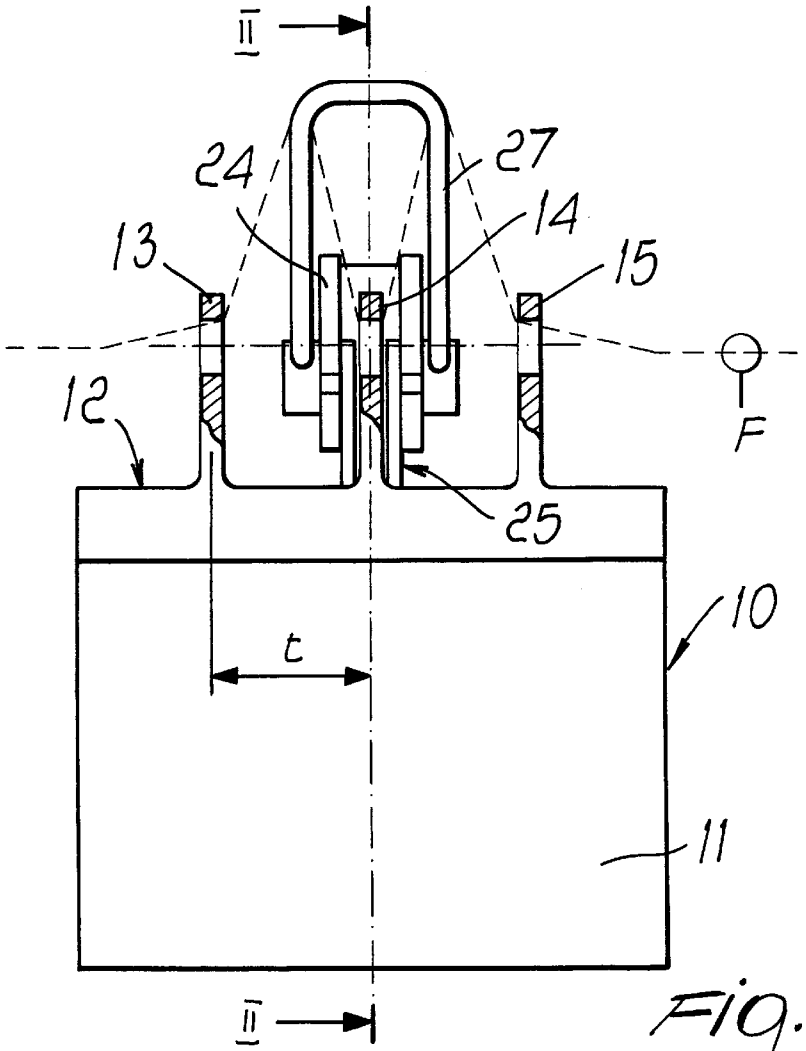
FIG. 1 is a front elevation view of a first embodiment of the braking device according to the present invention.
Figure 3A:
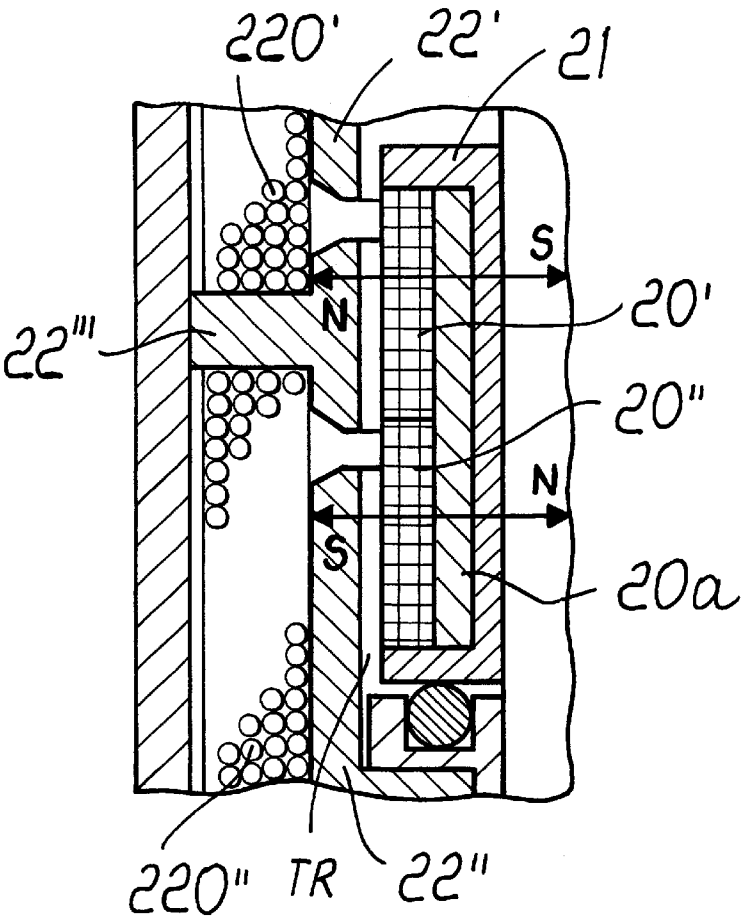
FIG. 3*a* is highly enlarged-scale view, similar to FIG. 3, of a second embodiment of the device according to the present invention.
Figure 3:
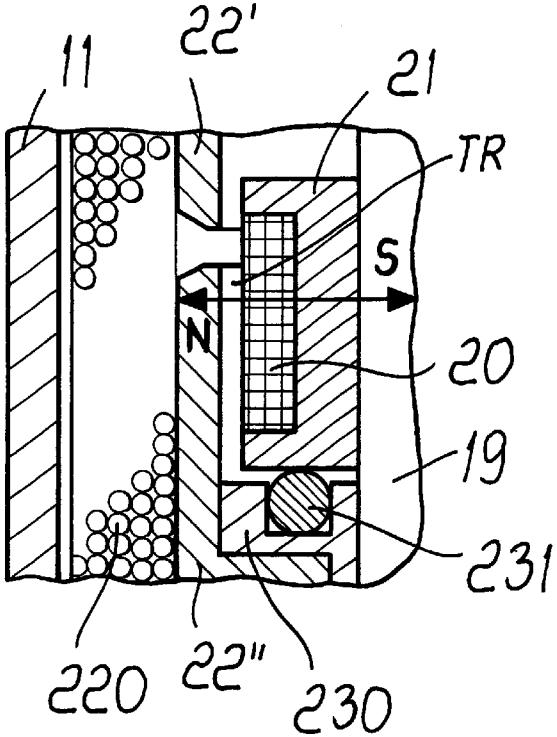
FIG. 3 is a highly enlarged-scale view of a detail of FIG. 2.

With reference to FIGS. 1 to 3, the reference numeral 10 designates a braking device, which comprises a box-like body 11 with a cover 12 to one side of which a set of three aligned yarn guiding eyes 13, 14 15 is arranged; the eyes are mutually spaced by a convenient extent "t" and form a straight path for a yarn F through the braking device 10.

A first oscillating lever 24 is articulated to the cover 12 and is pivoted to a support 25 of the cover; the braking element proper is rigidly coupled to the lever. The braking element is constituted by a second oscillating lever 27, which is U-shaped and is adapted to arrange itself so as to straddle the central eye 14 in order to engage the yarn F and divert its path in the free portions that lie between said central eye and the end eyes 13–15 (FIG. 1).

According to the present invention, the braking element 27 is actuated by an actuator which has a movable stem 19, with a transverse pivot which engages a slot 26 of the oscillating lever 24 and is provided with at least one permanent magnet which is constituted by a cylindrical body 20 made of a material having an extremely high magnetic hysteresis, typically neodymium or samarium-cobalt. The N-S polar axis of the cylindrical permanent-magnet body 20 is arranged radially and is preferably orientated so that the N polarity faces outward (FIG. 3). Said body is fitted on a support 21 made of nonmagnetic material, typically thermoplastic polymeric material, which is in turn rigidly coupled to the stem 19. Preferably, a cylindrical sleeve 20*a* made of ferromagnetic material (FIG. 3*a*) is interposed between the cylindrical body 20 and the support 21. The stem 19 moves in a linear fashion inside a cylindrical shroud 22 made of a material having high magnetic permeance which is arranged inside the box-like body 11 formed in two portions 22'–22" which are juxtaposed due to assembly requirements; each portion delimits a corresponding stator pole which is 15 separated from the cylindrical magnet body 20 by a gap TR. Each portion of the shroud 22 is provided with a corresponding bush 23 for the guiding and retention of the stem 19. The bushes have respective circular abutment surfaces 230 provided with annular seats for corresponding elastomeric rings 231 of the 0-ring type which are suitable to cushion the stroke limit impact of the support 21 against said circular abutment surfaces.

An excitation coil 220 is wound on the shroud 22 and is supplied in a conventional way by an excitation current I which varies with a rule which is equal to, and the inverse of, the rule with which the advancement speed of the yarn F varies.

With the above-described arrangement, the magnet 20 generates a field Φ whose lines of force, by concatenating with the lines of force of the field generated by the coil 220, produce an intense force F which is directed along the axis of the stem 19 and is expressed by the relation F=K.Br.Dm.n.I, where n is the number of turns of the coil 220, I is the excitation current, K is a constant whose value depends on the overall geometry of the system and on the type of permanent magnet 20, Br is the residual induction of said permanent magnet and Dm is its average diameter.

In the embodiment of FIG. 3*a*, which is suitable to generate a significantly higher magnetomotive force F for an equal power absorption, the cylindrical shroud 22 comprises a third cylindrical shroud portion 22'" which is interposed between the two juxtaposed portions 22'–22" and forms a corresponding third stator pole. In this case, two superimposed cylindrical permanent-magnet bodies 20'–20" are provided and rigidly coupled to the stem 19; those bodies have opposite radial polarities, as shown in the figure, and both are fitted on the support 21 with the cylindrical sleeve of ferromagnetic material 20*a* interposed. Likewise, the excitation coil 220 is split into two windings 220'–220" which are separated by the third shroud portion and are preferably electrically series-connected.

Figure 5:
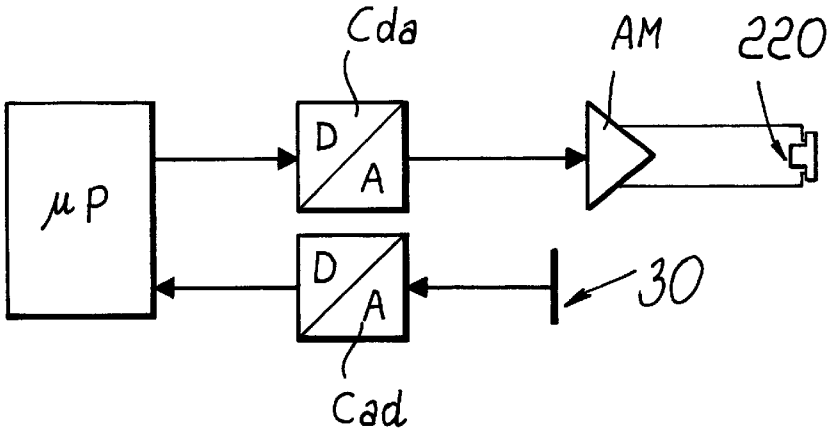
FIG. 5 is an electrical diagram of the means for generating and controlling the current supplied to the excitation coil.
Figure 4:
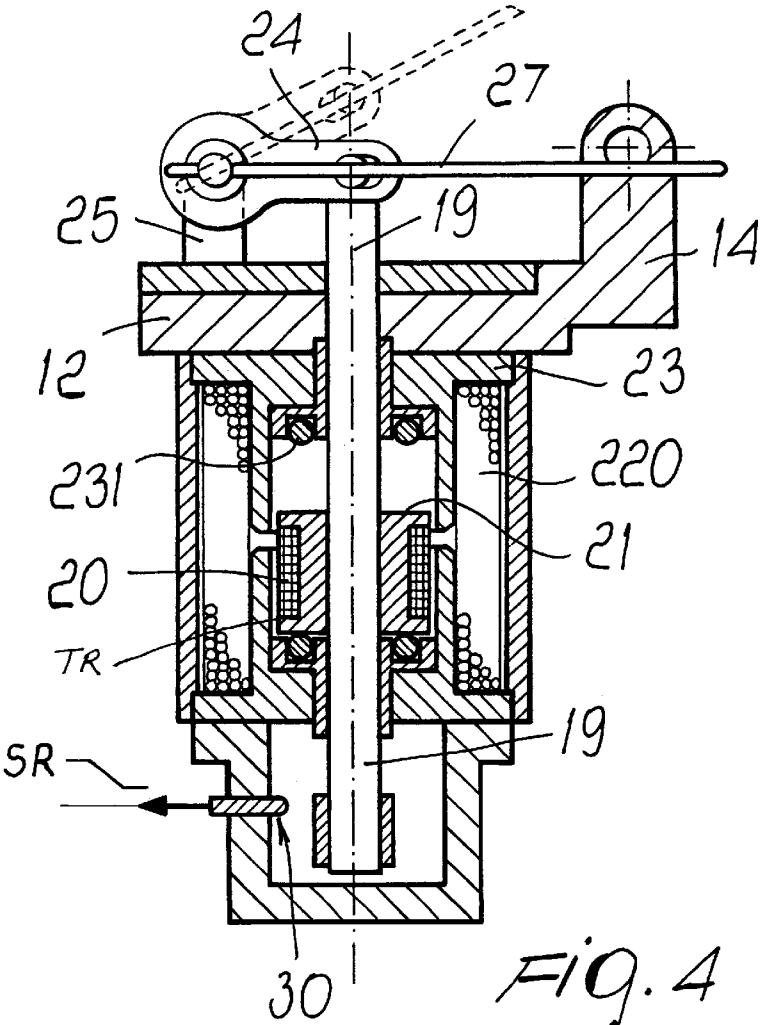
FIG. 4 is a sectional view, similar to FIG. 2, of a third embodiment of the device according to the present invention.

According to the different embodiment of FIG. 4, a linear motion sensor, generally designated by the reference numeral 30, is associated with the movable stem 19 of the device. The sensor is capable of providing an analog feedback signal SR, for example in terms of voltage, which can be used to control the movement of the stem 19. For this purpose, and as shown in FIG. 5, the feedback signal SR, after analog/digital conversion performed by a converter Cad, is applied to a microprocessor $\mu$P and is used to vary the excitation current I produced by a power transducer AM which is driven by the microprocessor with the interposition of a further digital/analog converter, designated by Cda.

In this way, the feedback signal SR can be used, for example, to reduce the travel speed of the stem 19 at the stroke limit points in order to avoid rebounding or in order to apply to the stem a preset rule of motion which is suitable to optimize the modulated braking of the yarn.

Without altering the concept of the present invention, the details of execution and the embodiments may of course be altered extensively with respect to what has been described and illustrated by way of nonlimitative example without thereby abandoning the scope of the invention.

What is claimed is:

1. A device for modulated braking of a weft yarn for textile machines, comprising a set of three yarn guiding eyes, which form a straight path for the yarn, and an oscillating lever, which is connected to a U-shaped braking element which straddles a central eye of said eyes and engages the yarn in free portions that lie between said central eye and the end eyes of said eyes in order to divert its straight path for braking, wherein said oscillating lever is controlled by an electromagnetic actuation means which comprises at least one permanent magnet which is constituted by a cylindrical body having a N-S polar axis arranged radially, said body being associated with a stem which is articulated to said oscillating lever and can move in a linear fashion inside a cylindrical shroud with high magnetic permeance, on which at least one coil is wound, with an excitation current flowing through said coil; the axis of said cylindrical shroud, which coincides with the axis of the movable stem, being perpendicular to the polar axis of said cylindrical permanent-magnet body, said cylindrical shroud being provided in at least two juxtaposed portions, each of which delimits a corresponding stator pole which is separated from the cylindrical permanent-magnet body by a gap, said cylindrical shroud comprising a third cylinder portion which is interposed between said juxtaposed portions and forms a corresponding third stator pole; said movable stem being provided with two cylindrical permanent-magnet bodies which have opposite radial polarities and are fitted and superimposed on the at least one coil being split into two windings which are separated by said third shroud portion and are electrically series-connected.

2. The device according to claim 1, wherein said cylindrical permanent-magnet body is made of one of the following magnetic materials: neodymium, samarium-cobalt.

3. The device according to claim 1, wherein said cylindrical parmanent-magnet body is fitted on a support made of polymneric material which is stably coupled to said movable stem.

4. The device according to claim 3, wherein said cylindrical permanent-magnet body is rigidly coupled to the support made of polymeric material with a cylindrical sleeve made of ferromagnetic material interposed.

5. The device according to claim 1, wherein said juxtaposed portions of the cylindrical shroud are provided with respective bushings for the guiding and retention of the movable stem.

6. The device according to claim 5, wherein said bushings are provided with respective circular abutment surfaces which have annular seats for corresponding elastomeric rings which are suitable to cushion the stroke limit impact of said support against said circular abutment surfaces.

7. The device according to claim 1, wherein the movable stem of the electromagnetic actuation means has a linear motion sensor associated therewith, said sensor being capable of providing a feedback signal which allows to control the excitation current which is Supplied to the excitation coil and accordingly to control the speed and/or the criteria of the motion of said stem.

* * * * *